US008763376B2

(12) United States Patent
Garnepudi

(10) Patent No.: US 8,763,376 B2
(45) Date of Patent: Jul. 1, 2014

(54) EXHAUST GAS HEAT RECOVERY SYSTEM AND TRANSMISSION WARMER IMPLEMENTATION STRATEGY FOR A VEHICLE

(75) Inventor: Gopala K. Garnepudi, Oakland Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 252 days.

(21) Appl. No.: 13/308,599

(22) Filed: Dec. 1, 2011

(65) Prior Publication Data

US 2013/0139491 A1 Jun. 6, 2013

(51) Int. Cl.
*F01N 3/00* (2006.01)

(52) U.S. Cl.
USPC ..... 60/298; 60/320; 60/321; 165/66; 123/41.05

(58) Field of Classification Search
USPC ..... 60/274–324
See application file for complete search history.

(56) References Cited

U.S. PATENT DOCUMENTS

| | | | | |
|---|---|---|---|---|
| 6,772,715 | B2 * | 8/2004 | Pfeffinger et al. | 123/41.31 |
| 7,467,605 | B2 * | 12/2008 | Szalony et al. | 123/41.04 |
| 7,536,998 | B2 * | 5/2009 | Held et al. | 123/542 |
| 8,463,495 | B2 * | 6/2013 | Spohn et al. | 701/36 |
| 2009/0133646 | A1 * | 5/2009 | Wankhede et al. | 123/41.31 |
| 2011/0067389 | A1 | 3/2011 | Prior | |
| 2011/0088378 | A1 * | 4/2011 | Prior et al. | 60/320 |
| 2012/0067545 | A1 | 3/2012 | Yamazaki et al. | |
| 2012/0102952 | A1 | 5/2012 | Spohn et al. | |
| 2013/0020398 | A1 * | 1/2013 | Goto et al. | 237/12.4 |

FOREIGN PATENT DOCUMENTS

| | | | | |
|---|---|---|---|---|
| DE | 10161851 | A1 | 6/2003 | |
| DE | 102010046151 | A1 | 2/2012 | |
| DE | 102011053591 | A1 | 3/2012 | |
| DE | 102011116923 | A1 | 5/2012 | |
| WO | WO 2011108067 | * | 9/2011 | B60L 11/14 |

* cited by examiner

*Primary Examiner* — Jesse Bogue
(74) *Attorney, Agent, or Firm* — Quinn Law Group, PLLC

(57) ABSTRACT

A vehicle includes a coolant circuit that circulates a flow of an engine coolant therethrough. The coolant circuit includes an Exhaust Gas Heat Recover (EGHR) system for transferring heat from a flow of exhaust gas from an internal combustion engine to the flow of the engine coolant. A control valve is disposed downstream of the EGHR system, and directs the flow of the engine coolant along either a first fluid flow path back to the internal combustion engine to heat the internal combustion engine, or a second fluid flow path including a transmission fluid warming system to heat a supply of transmission fluid to reduce transmission spin loss.

6 Claims, 2 Drawing Sheets

EXHAUST GAS HEAT RECOVERY SYSTEM AND TRANSMISSION WARMER IMPLEMENTATION STRATEGY FOR A VEHICLE

TECHNICAL FIELD

The invention generally relates to a coolant circuit for a vehicle for selectively warming an internal combustion engine or a supply of transmission fluid, and a method of operating the vehicle to selectively warm the internal combustion engine or the transmission fluid.

BACKGROUND

Vehicles often include an automatic transmission using a fluid coupling, i.e., a torque converter, to transmit torque between an internal combustion engine and the automatic transmission. Energy is lost through the fluid coupling. This energy loss is often referred to as the "transmission spin loss". When the fluid of the fluid coupling, i.e., the transmission fluid, is cold, the transmission spin loss is greater. The quicker the transmission fluid warms up, the quicker the transmission spin loss is reduced, thereby improving energy efficiency of the vehicle.

SUMMARY

A vehicle is provided. The vehicle includes an internal combustion engine having a fluid outlet and a fluid inlet in fluid communication with each other. The fluid inlet and the fluid outlet are configured for circulating a flow of an engine coolant from the fluid inlet to the fluid outlet. A coolant circuit interconnects the fluid outlet and the fluid inlet in fluid communication. The coolant circuit circulates the flow of the engine coolant therethrough from the fluid outlet to the fluid inlet. The coolant circuit includes an Exhaust Gas Heat Recovery (EGHR) system that is disposed downstream from the fluid outlet. The EGHR system transfers heat from a flow of exhaust gas from the internal combustion engine to the engine coolant. A control valve is disposed downstream from and in fluid communication with the EGHR system. A first fluid flow path is disposed in fluid communication with and located downstream of the control valve. A second fluid flow path is also disposed in fluid communication with and located downstream of the control valve. A transmission fluid warming system is disposed along the second fluid flow path. The control valve directs the flow of the engine coolant along the first fluid flow path when a temperature of the engine coolant is below a pre-defined temperature, and directs the flow of the engine coolant along the second fluid flow path when the temperature of the engine coolant is equal to or greater than the pre-defined temperature.

A coolant circuit for a vehicle is also provided. The coolant circuit includes an internal combustion engine having a fluid outlet and a fluid inlet in fluid communication with each other. The fluid outlet and the fluid inlet are configured for circulating a flow of an engine coolant from the fluid inlet to the fluid outlet. A heater core is disposed downstream of and in fluid communication with the fluid outlet of the internal combustion engine. An Exhaust Gas Heat Recovery (EGHR) system is disposed downstream from the heater core. The EGHR system is configured for transferring heat from a flow of exhaust gas from the internal combustion engine to the engine coolant. A control valve is disposed downstream from and in fluid communication with the EGHR system. A first fluid flow path is disposed in fluid communication with and located downstream of the control valve. A second fluid flow path is also disposed in fluid communication with and located downstream of the control valve. A transmission fluid warming system is disposed along the second fluid flow path. An Exhaust Gas Recirculation (EGR) system is disposed in fluid communication with and located downstream of both the first fluid flow path and the second fluid flow path. The EGR system is also disposed in fluid communication with and located upstream of the fluid inlet of the internal combustion engine. The control valve directs the flow of the engine coolant along the first fluid flow path when a temperature of the engine coolant is below a pre-defined temperature, and directs the flow of the engine coolant along the second fluid flow path when the temperature of the engine coolant is equal to or greater than the pre-defined temperature.

A method of operating a vehicle is also provided. The method includes operating an internal combustion engine, and circulating a flow of an engine coolant through a coolant circuit in fluid communication with the internal combustion engine. The engine coolant circulating through the coolant circuit is heated with an Exhaust Gas Heat Recovery (EGHR) system. When a temperature of the engine coolant exiting the internal combustion engine is equal to or greater than a pre-defined temperature, a supply of transmission fluid is heated with the flow of the engine coolant circulating through the coolant circuit after the flow of the engine coolant is heated with the EGHR system. When the temperature of the engine coolant exiting the internal combustion engine is less than the pre-defined temperature, the internal combustion engine is heated with the flow of the engine coolant circulating through the coolant circuit after the flow of the engine coolant is heated with the EGHR system.

Accordingly, the control valve directs the flow of the engine coolant to either the internal combustion engine or the transmission fluid warming system. If temperature of the engine coolant is less than the pre-defined temperature, then the coolant circuit heats the flow of the engine coolant with the EGHR system and the control valve directs the flow of the engine coolant back to the internal combustion engine to more quickly warm the internal combustion engine, thereby improving the operating efficiency of the vehicle. If the temperature of the engine coolant is equal to or greater than the pre-defined temperature, then the coolant circuit heats the flow of the engine coolant with the EGHR system and then the control valve directs the flow of the engine coolant to the transmission fluid warming system to warm the transmission fluid, thereby reducing transmission spin loss and improving the operating efficiency of the vehicle.

The above features and advantages and other features and advantages of the present invention are readily apparent from the following detailed description of the best modes for carrying out the invention when taken in connection with the accompanying drawings.

DETAILED DESCRIPTION

Figure 1:
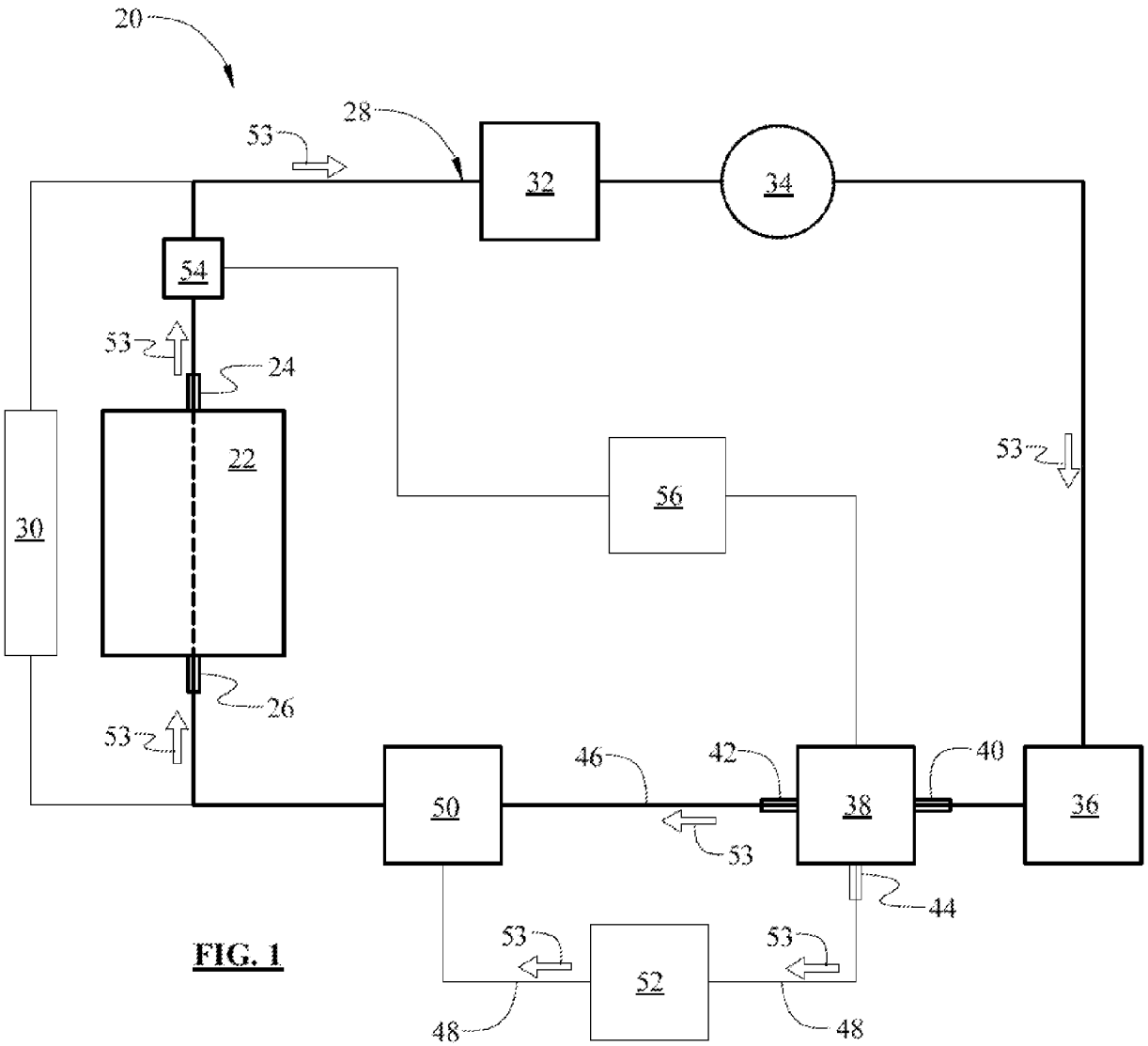
FIG. 1 is a schematic diagram of a vehicle showing a coolant circuit circulating a flow of an engine coolant through a first fluid flow path to heat an internal combustion engine.

Those having ordinary skill in the art will recognize that terms such as "above," "below," "upward," "downward,"

"top," "bottom," etc., are used descriptively for the figures, and do not represent limitations on the scope of the invention, as defined by the appended claims.

Referring to the Figures, wherein like numerals indicate like parts throughout the several views, a vehicle is generally shown at 20. The vehicle 20 may include any type and/or style of vehicle 20, including but not limited to a hybrid vehicle.

The vehicle 20 includes an internal combustion engine 22. The internal combustion engine 22 may include but is not limited to a gasoline engine or a diesel engine. The internal combustion engine 22 includes a fluid outlet 24 and a fluid inlet 26 in fluid communication with each other. The internal combustion engine 22 circulates a flow of an engine coolant from the fluid inlet 26 to the fluid outlet 24. It should be appreciated that as the engine coolant circulates through the internal combustion engine 22, between the fluid inlet 26 and the fluid outlet 24, heat generated through the operation of the internal combustion engine 22 is transferred and/or absorbed by the engine coolant.

The vehicle 20 further includes a coolant circuit 28. The coolant circuit 28 defines a passageway for the engine coolant to flow through in a continuous loop. The coolant circuit 28 interconnects the fluid outlet 24 and the fluid inlet 26 in fluid communication, and circulates the flow of the engine coolant therethrough from the fluid outlet 24 to the fluid inlet 26. Accordingly, it should be appreciated that the engine coolant flows in a continuous circuit through the internal combustion engine 22 and through the coolant circuit 28. It should be appreciated that the vehicle 20 may include one or more other fluid circuits that are coupled to and in fluid communication with the coolant circuit 28 herein described below, for example, that circulate the engine coolant through a primary radiator 30 to cool the engine coolant.

The coolant circuit 28 includes a heater core 32 that is disposed downstream of and in fluid communication with the fluid outlet 24 of the internal combustion engine 22. The heater core 32 includes a heat exchanger that transfers heat from the flow of the engine coolant to a flow of air that is circulated through an interior cabin area of the vehicle 20 to heat the cabin area.

The cooling circuit further includes a pump 34. As shown, the pump 34 is disposed downstream of and in fluid communication with the heater core 32. The pump 34 circulates the engine coolant through the coolant circuit 28. The pump 34 may include any suitable size and/or style of fluid pump, and is preferably but not necessarily electrically driven, and may include, for example, a 12 volt fluid pump.

The cooling circuit further includes an Exhaust Gas Heat Recovery (EGHR) system 36. The EGHR system 36 is disposed downstream from the fluid outlet 24. More specifically and as shown, the EGHR system 36 is disposed downstream of the pump 34. As such, the heater core 32 and the pump 34 are both disposed upstream from and in fluid communication with the EGHR system 36. The EGHR system 36 may include any system having a heat exchanger capable of transferring heat from a flow of exhaust gas from the internal combustion engine 22 to the engine coolant. As is known, the internal combustion engine 22 generates a flow of heated exhaust gas during operation. The EGHR system 36 recovers heat from the flow of exhaust gas and transfers the heat to the engine coolant flowing through the coolant circuit 28.

The coolant circuit 28 further includes a control valve 38. The control valve 38 is disposed downstream from and in fluid communication with the EGHR system 36. The control valve 38 may include, for example, a three port valve having an input 40 for receiving the flow of the engine coolant from the EGHR system 36, and two separate and distinct outputs, i.e., a first output 42 and a second output 44, each configured for directing the flow of the engine coolant along a different path. The first output 42 of the control valve 38 is connected to and in fluid communication with a first fluid flow path 46. As such, the first fluid flow path 46 is disposed downstream of the control valve 38. The second output 44 of the control valve 38 is connected to and in fluid communication with a second fluid flow path 48. As such, the second fluid flow path 48 is also disposed downstream of the control valve 38.

The coolant circuit 28 further includes an Exhaust Gas Recirculation (EGR) system 50. The EGR system 50 is disposed in fluid communication with and located downstream of the first fluid flow path 46 and the second fluid flow path 48. Accordingly, each of the first fluid flow path 46 and the second fluid flow path 48 interconnect the control valve 38 and the EGR system 50, with each of the first fluid flow path 46 and the second fluid flow path 48 defining a separate and distinct flow path for the flow of the engine coolant between the control valve 38 and the EGR system 50. The EGR system 50 is also disposed in fluid communication with and located upstream of the fluid inlet 26 of the internal combustion engine 22. The EGR system 50 includes a heat exchanger that is capable of transferring heat from the flow of coolant circulating through the coolant circuit 28 back to the internal combustion engine 22.

A transmission fluid warming system 52 is disposed along and within the second fluid flow path 48. The transmission fluid warming system 52 is configured to heat a supply of transmission fluid. The transmission fluid warming system 52 includes a heat exchanger capable of transferring heat from the flow of engine coolant circulating through the second fluid path of the coolant circuit 28 to the supply of transmission fluid.

Figure 2:
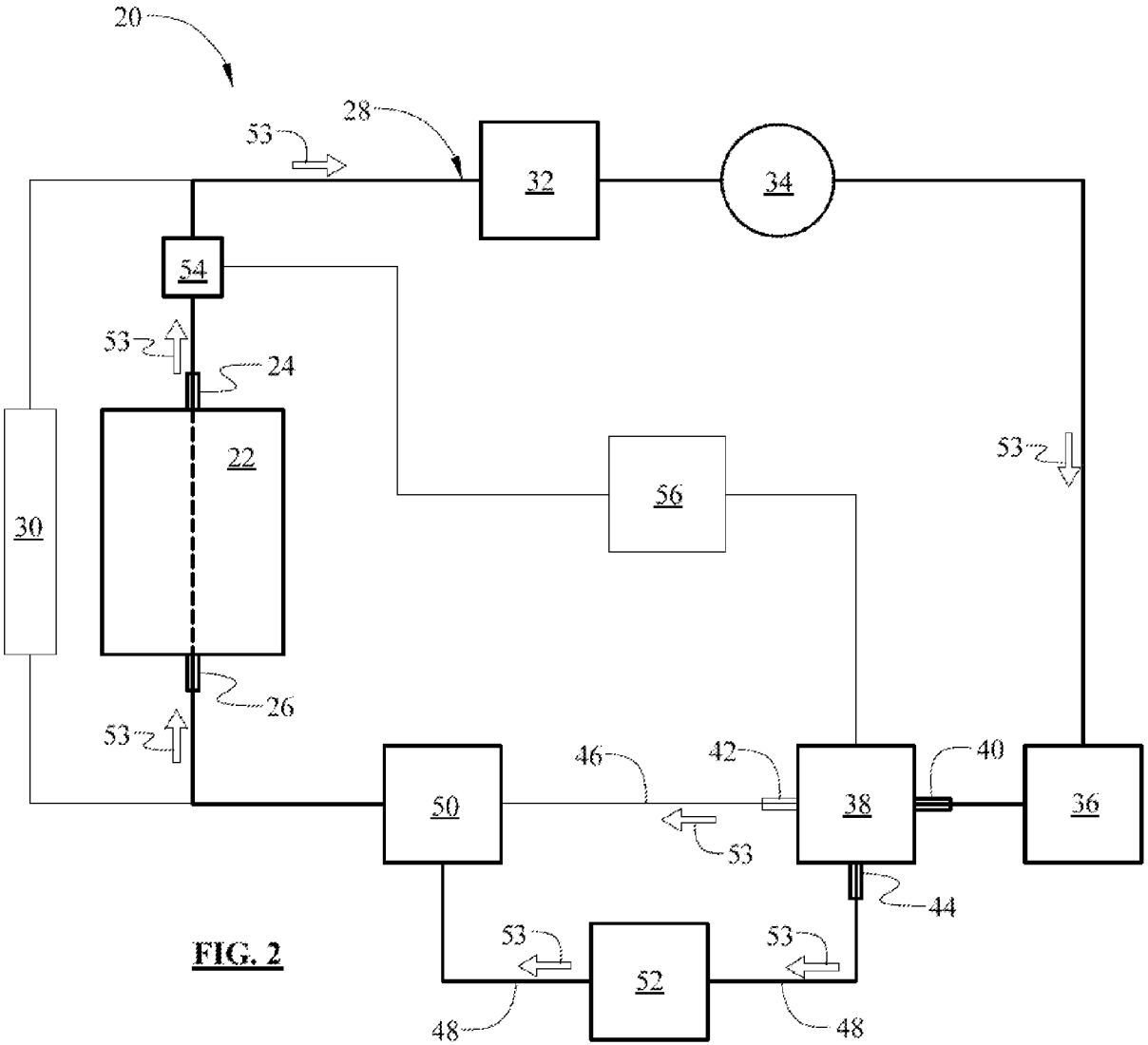
FIG. 2 is a schematic diagram of the vehicle showing the coolant circuit circulating the flow of the engine coolant through a second fluid flow path to a transmission fluid warming system to heat a supply of transmission fluid.

As shown in FIG. 1, the control valve 38 directs the flow of the engine coolant along the first fluid flow path 46 when a temperature of the engine coolant is below a pre-defined temperature. As shown in FIG. 2, the control valve 38 directs the flow of the engine coolant along the second fluid flow path 48 when the temperature of the engine coolant is equal to or greater than the pre-defined temperature. The pre-defined temperature may be defined as a desired operating temperature of the internal combustion engine 22, and may include a temperature between the range of 60° C. and 70° C. It should be appreciated that the exact value of the pre-defined temperature may differ depending upon the exact size and configuration of the internal combustion engine 22 and/or vehicles. Furthermore, it should be appreciated that the pre-defined temperature may differ from the preferred range described above.

The EGR system 50 receives the flow of the engine coolant from the control valve 38 through the first fluid flow path 46 when the control valve 38 directs the flow of the engine coolant through the first fluid flow path 46. The first fluid flow path 46 bypasses the transmission fluid warming system 52, disposed along the second fluid flow path 48, thereby preserving heat within the flow of the engine coolant to be transferred to the EGR system 50 to be used to heat the internal combustion engine 22. Accordingly, when the internal combustion engine 22 is initially started, the control valve 38 directs the flow of the engine coolant through the first fluid flow path 46 to minimize the time required to heat the internal combustion engine 22 to an efficient operating temperature.

The control valve 38 directs the flow of the engine coolant along the second fluid flow path 48 when the temperature of the engine coolant is equal to or greater than the pre-defined temperature. Accordingly, when the control valve 38 directs the flow of the engine coolant through the second fluid flow path 48, the EGR system 50 receives the flow of the engine coolant from the second fluid flow path 48, and more specifically from the transmission fluid warming system 52. When the temperature of the engine coolant is equal to or greater than the pre-defined temperature, then the control valve 38 directs the flow of the engine coolant along the second fluid flow path 48 and to the transmission fluid warming system 52 to warm the transmission fluid. In so doing, the transmission fluid is quickly heated, thereby reducing the transmission spin loss within the transmission.

The engine coolant flows from the EGR system 50 to the fluid inlet 26 of the internal combustion engine 22. Accordingly, it should be appreciated that the engine coolant flows through the coolant circuit 28 in a continuous loop in a direction indicated by arrows 53. As such, the engine coolant flows in sequence from the fluid outlet 24 to the heater core 32, from the heater core 32 to the pump 34, from the pump 34 to the EGHR system 36, from the EGHR system 36 to the control valve 38, from the control valve 38 to the EGR system 50 via one of the first fluid flow path 46 or the second fluid flow path 48, from the EGR system 50 to the fluid inlet 26, and from the fluid inlet 26 back to the fluid outlet 24, whereupon the engine coolant re-enters the coolant circuit 28.

The vehicle 20 may include a temperature sensor 54 configured for sensing a temperature of the engine coolant. The temperature sensor 54 may include any suitable sensor capable of sensing the temperature of the engine coolant within the internal combustion engine 22 and/or within the coolant circuit 28. Preferably, the temperature sensor 54 is positioned to sense the temperature of the engine coolant at or near the fluid outlet 24 of the internal combustion engine 22. The temperature sensor 54 may be electronically coupled to a control module 56, and be configured to send a signal indicating the temperature of the engine coolant thereto. The control module 56 may include but is not limited to a computer having all necessary hardware, software, control algorithms, communication links, memory, etc., necessary to communicate with the temperature sensor 54 and control the control valve 38. The control module 56 may receive the signal from the temperature sensor 54 and determine if the sensed temperature of the engine coolant is less than, equal to or greater than the pre-defined temperature. The control module 56 then signals the control valve 38, based on the determination that the temperature of the engine coolant is less than, equal to or greater than the pre-defined temperature, to direct the flow of the engine coolant along one of the first fluid flow path 46 or the second fluid flow path 48 as described above. Alternatively, the temperature sensor 54 may send a signal directly to the control valve 38, with the control valve 38 configured to respond to the signal from the temperature sensor 54 to direct the flow of the engine coolant along one of the first fluid flow path 46 or the second fluid flow path 48 as described above.

A method of operating a vehicle 20 is also provided. The method includes operating or running the internal combustion engine 22. As is known, the internal combustion engine 22 produces a flow of heated exhaust gas as a result of operation. The flow of exhaust gas from the internal combustion engine 22 is directed through the EGHR system 36, and a portion of the exhaust gas is further directed through the EGR system 50. The flow of the engine coolant is circulated through the coolant circuit 28 and the internal combustion engine 22 while the internal combustion engine 22 is operating. Heat generated from the internal combustion engine 22 is absorbed by the engine coolant. The engine coolant circulating through the coolant circuit 28 is further heated via the exhaust gas flowing through the EGHR system 36.

A temperature of the engine coolant is continuously measured. Preferably, the temperature of the engine coolant is measured adjacent or near the fluid outlet 24 of the internal combustion engine 22. As described above, the temperature of the engine coolant may be measured with the temperature sensor 54. The method further includes determining if the measured temperature of the engine coolant is less than, equal to or greater than the pre-defined temperature. As described above, the temperature sensor 54 may send a signal to the control module 56, which then analyzes the signal from the temperature sensor 54 and/or determines if the temperature of the engine coolant is less than, equal to or greater than the pre-defined temperature.

When the temperature of the engine coolant exiting the internal combustion engine 22 is less than the pre-defined temperature, the internal combustion engine 22 is heated with the flow of the engine coolant circulating through the coolant circuit 28, after the flow of the engine coolant is heated with the EGHR system 36. If the temperature of the engine coolant is less than the pre-defined temperature, then the control valve 38 is signaled to direct the flow of the engine coolant through the first fluid flow path 46. As described above, the signal to the control valve 38 may originate from the control module 56, or may come directly from the temperature sensor 54. Once the control valve 38 is signaled, heating the internal combustion engine 22 includes manipulating the control valve 38 to direct the flow of the engine coolant through the first fluid flow path 46, thereby bypassing the transmission fluid warming system 52.

When the temperature of the engine coolant exiting the internal combustion engine 22 is equal to or greater than the pre-defined temperature, the supply of transmission fluid is heated with the flow of the engine coolant circulating through the coolant circuit 28, after the flow of the engine coolant is heated with the EGHR system 36. If the temperature of the engine coolant is equal to or greater than the pre-defined temperature, then the control valve 38 is signaled to direct the flow of the engine coolant through the second fluid flow path 48, thereby circulating the flow of the engine coolant through the transmission fluid warming system 52. As described above, the signal to the control valve 38 may originate from the control module 56, or may come directly from the temperature sensor 54. Once the control valve 38 is signaled, heating the transmission fluid includes manipulating the control valve 38 to direct the flow of the engine coolant through the second fluid flow path 48, thereby directing the flow of the engine coolant through the transmission fluid warming system 52.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A vehicle comprising:

an internal combustion engine having a fluid outlet and a fluid inlet in fluid communication with each other and configured for circulating a flow of an engine coolant from the fluid inlet to the fluid outlet; and a coolant circuit interconnecting the fluid outlet and the fluid inlet in fluid communication and circulating the flow of the engine coolant therethrough from the fluid outlet to the fluid inlet, the coolant circuit including:

a pump disposed downstream of and in fluid communication with the fluid outlet, and configured for circulating the engine coolant through the coolant circuit;

an Exhaust Gas Heat Recovery (EGHR) system disposed downstream from the pump and from the fluid outlet, and configured for transferring heat from a flow of exhaust gas from the internal combustion engine to the engine coolant;

a control valve disposed downstream from and in fluid communication with the EGHR system;

a first fluid flow path in fluid communication with and disposed downstream of the control valve;

a second fluid flow path in fluid communication with and disposed downstream of the control valve;

wherein the pump circulates the engine coolant through the entire coolant circuit, including both the first fluid flow path and the second fluid flow path of the coolant circuit;

a transmission fluid warming system disposed along the second fluid flow path;

wherein the control valve directs the flow of the engine coolant along the first fluid flow path when a temperature of the engine coolant is below a pre-defined temperature, and directs the flow of the engine coolant along the second fluid flow path when the temperature of the engine coolant is equal to or greater than the pre-defined temperature;

an Exhaust Gas Recirculation (EGR) system in fluid communication with and disposed downstream of the first fluid flow path and the second fluid flow path, and in fluid communication with and disposed upstream of the fluid inlet of the internal combustion engine;

wherein the EGR system is operable to transfer heat from the flow of the engine coolant circulating through the coolant circuit to the internal combustion engine; and wherein the EGR system is configured to receive the flow of the engine coolant from the control valve through the first fluid flow path when the control valve directs the flow of the engine coolant through the first fluid flow path, and wherein the EGR system is configured to receive the flow of the engine coolant from the transmission fluid warming system when the control valve directs the flow of the engine coolant through the second fluid flow path.

2. A vehicle as set forth in claim 1 further comprising a heater core disposed downstream of and in fluid communication with the fluid outlet of the internal combustion engine, and disposed upstream from the EGHR system.

3. A vehicle as set forth in claim 2 wherein the pump is disposed downstream of and in fluid communication with the heater core, and is disposed upstream of and in fluid communication with the EGHR system.

4. A vehicle as set forth in claim 3 further comprising a temperature sensor configured for sensing a temperature of the engine coolant exiting the internal combustion engine at the fluid outlet.

5. A vehicle as set forth in claim 3 wherein the engine coolant flows through the coolant circuit in a continuous loop from the fluid outlet to the heater core, from the heater core to the pump, from the pump to the EGHR system, from the EGHR system to the control valve, from the control valve to the EGR system via one of the first fluid flow path or the second fluid flow path, from the EGR system to the fluid inlet, and from the fluid inlet back to the fluid outlet.

6. A coolant circuit for a vehicle, the coolant circuit comprising:

an internal combustion engine having a fluid outlet and a fluid inlet in fluid communication with each other and configured for circulating a flow of an engine coolant from the fluid inlet to the fluid outlet;

a heater core disposed downstream of and in fluid communication with the fluid outlet of the internal combustion engine;

an Exhaust Gas Heat Recovery (EGHR) system disposed downstream from the heater core and configured for transferring heat from a flow of exhaust gas from the internal combustion engine to the engine coolant;

a pump disposed downstream of and in fluid communication with the heater core and disposed upstream of the EGHR system;

a control valve disposed downstream from and in fluid communication with the EGHR system;

a first fluid flow path in fluid communication with and disposed downstream of the control valve;

a second fluid flow path in fluid communication with and disposed downstream of the control valve;

a transmission fluid warming system disposed along the second fluid flow path; and an Exhaust Gas Recirculation (EGR) system in fluid communication with and disposed downstream of both the first fluid flow path and the second fluid flow path, and in fluid communication with and disposed upstream of the fluid inlet of the internal combustion engine;

wherein the EGR system is operable to transfer heat from the flow of the engine coolant circulating through the coolant circuit to the internal combustion engine;

wherein the control valve directs the flow of the engine coolant along the first fluid flow path when a temperature of the engine coolant is below a pre-defined temperature, and directs the flow of the engine coolant along the second fluid flow path when the temperature of the engine coolant is equal to or greater than the pre-defined temperature; and wherein the pump is operable to circulate the engine coolant through the entire coolant circuit, including both the first fluid flow path and the second fluid flow path of the coolant circuit.

* * * * *